United States Patent [19]

Bini

[11] Patent Number: 4,864,833

[45] Date of Patent: Sep. 12, 1989

[54] CONTROL DEVICE FOR ADJUSTING THE RADIAL POSITION OF THE SINKERS IN A CIRCULAR KNITTING MACHINE

[75] Inventor: Franco Bini, Pordenone, Italy

[73] Assignee: Savio S.p.A., Pordenone, Italy

[21] Appl. No.: 151,620

[22] Filed: Feb. 2, 1988

[30] Foreign Application Priority Data

Feb. 3, 1987 [IT] Italy ..... 19233 A/87

[51] Int. Cl.[4] ..... D04B 15/24

[52] U.S. Cl. ..... 66/55; 66/108 R

[58] Field of Search ..... 66/54, 55, 107, 108 R, 66/108 A

[56] References Cited

U.S. PATENT DOCUMENTS 3,318,113 5/1967 Nebel ..... 66/108 R

FOREIGN PATENT DOCUMENTS 2856602 7/1980 Fed. Rep. of Germany ..... 66/54

585894 2/1947 United Kingdom ..... 66/49

2141445 12/1984 United Kingdom ..... 66/107

*Primary Examiner*—Wm. Carter Reynolds

*Attorney, Agent, or Firm*—Stevens, Davis, Miller & Mosher

[57] ABSTRACT

A control device for adjusting the radial position of the sinkers in a circular knitting machine, consitituted by a couple of cams for the radial drive of the sinkers. The cams are co-planar and concentrical with the axis of the cylinder and substantially circular. The innermost cam is stationary. The outermost cam is radially approachable and pushable away due to the effect of a countercam externally placed around the outermost cam and provided with approaching and pushing-away lengths, which, by means of the countercam's discrete revolution, radially approaches the outermost cam, and pushes the outermost cam away.

7 Claims, 5 Drawing Sheets

Fig.3
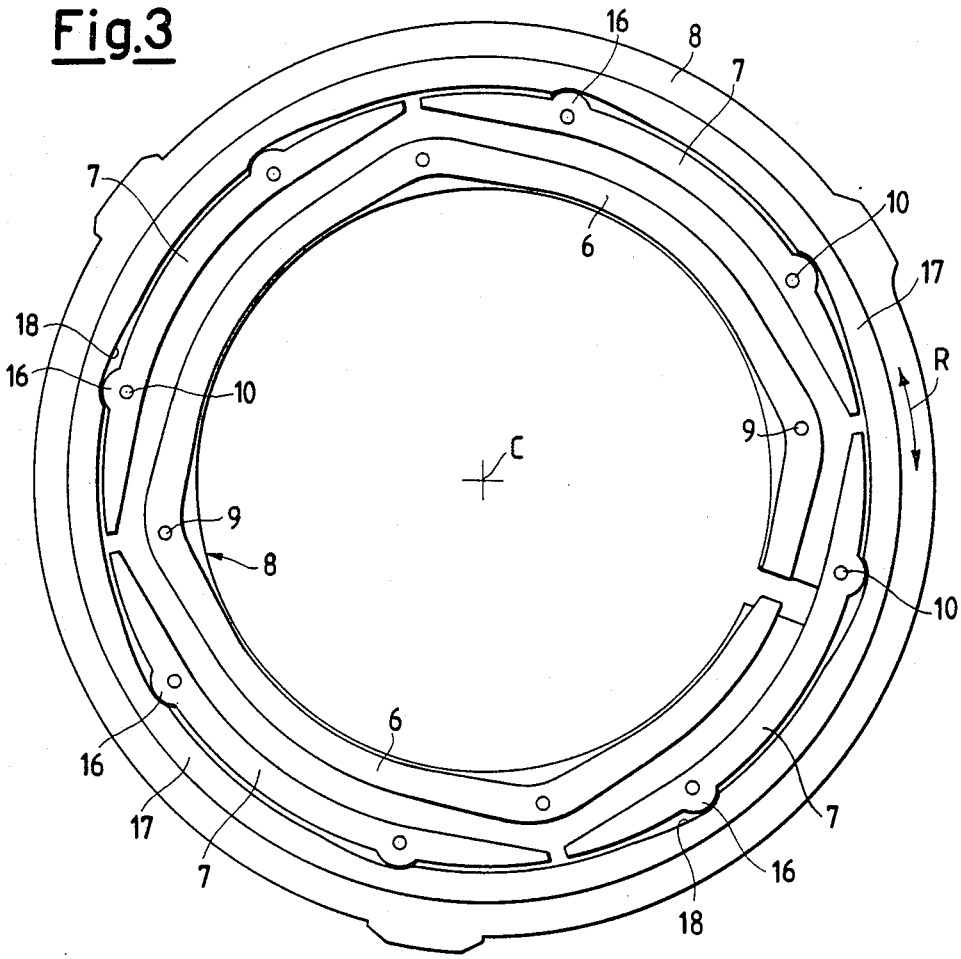
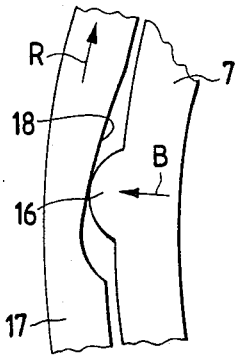
Fig.3A
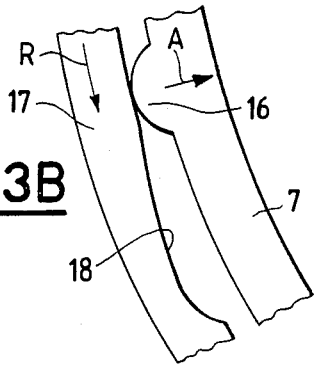
Fig.3B

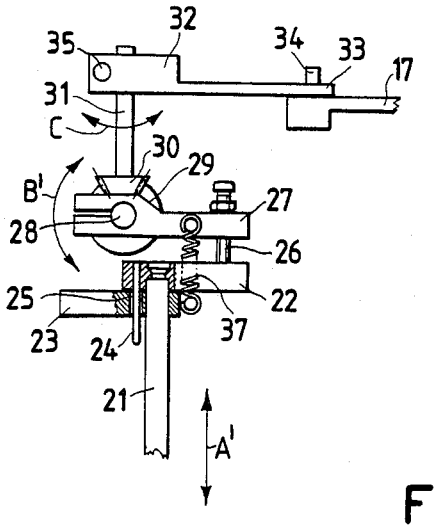
Fig.5B
Fig.5A
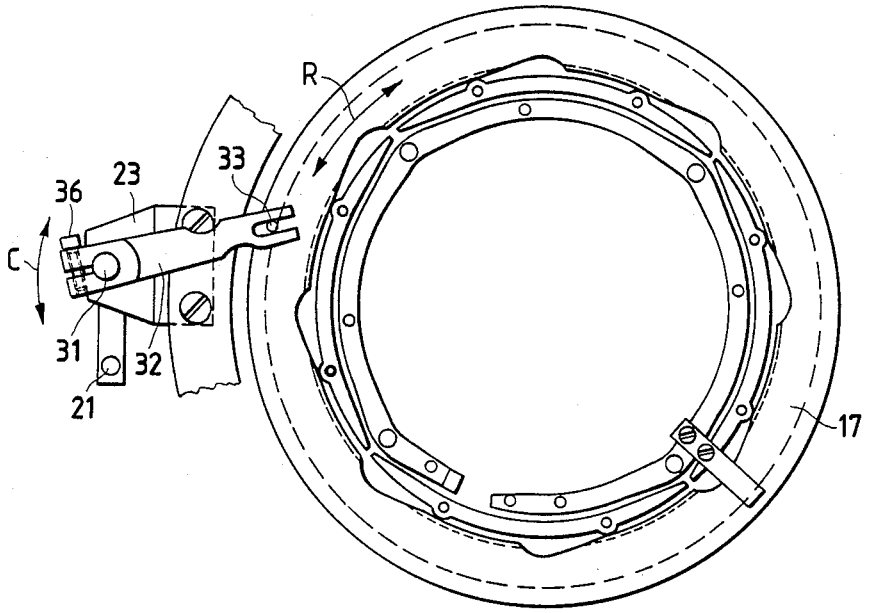

CONTROL DEVICE FOR ADJUSTING THE RADIAL POSITION OF THE SINKERS IN A CIRCULAR KNITTING MACHINE

The present invention relates to a device for adjusting and controlling the position of the sinkers in circular knitting machines, and, in particular for regulating and adjusting their radial position in those machines which are equipped with devices for varying the density of the formed fabric, by means of the effect of the axial shift of the ring of sinkers on which the feed yarn is tucked, due to the effect of the reciprocating motion of the needles which cooperate with them in order to form the stitch loops.

According to the prior art, in the circular knitting machines, the stitch loops are in fact formed by the vertical reciprocating movement of the needles running inside the slots provided along the generatrices of the revolving cylinder, and of movable sinkers which are mounted on a ring located at the same end of the cylinder, in such a position that the feed yarn comes into engagement with a needle, with a sinker, with the subsequent needle, and so on. It is also known that, in order to obtain a good operation and a good-quality product, the sinkers must be given a certain radial mobility, in order to always keep properly tensioned the loops, in order to enable the needle latch to open, and the formed stitch course to be discharged, with the needle being prevented from penetrating, during the production of the subsequent course, the loops formed in the preceding course. Should such an event occur, a faulty knitted fabric would be produced.

The need is known as well, during the production of a tubular knitted fabric destined, e.g., to form a hosiery article, for the length of the stitch loops formed at each course, viz., the density of the fabric, to be changed, in order to obtain lengths of tubular knitted fabric showing different extensibility.

This is generally achieved by axially shifting the ring of sinkers, driven by means of lifting cams. An equivalent contrivance to it is, on the contrary, the axial shift, to the opposite direction, of the stitch forming cams acting on the needle butts. This, because such a contrivance is equivalent to the shifting, relatively to the sinker knocking-over plane (the A or B level in FIGS. 1A and 1B), of the whole path of the needles.

Other details and features of the invention will stand out from the description given below by way by non-limitative example and with reference to the accompanying drawings, in which:

FIG. 3 shows an annular support of the present invention carrying a countercam outside of the inner and outer cams;

FIG. 3A shows the position of the countercam of FIG. 3 with respect to the outer cam when the sinker is in the position corresponding to long loops;

FIG. 3B shows the position of the countercam of FIG. 3 with respect to the outer cam when the sinker is in the position corresponding to short loops;

FIG. 5A shows a top plan view of the countercam of FIG. 4; and

FIG. 5B shows a side view of the conical-gearing control of FIG. 4.

Figure 1B:
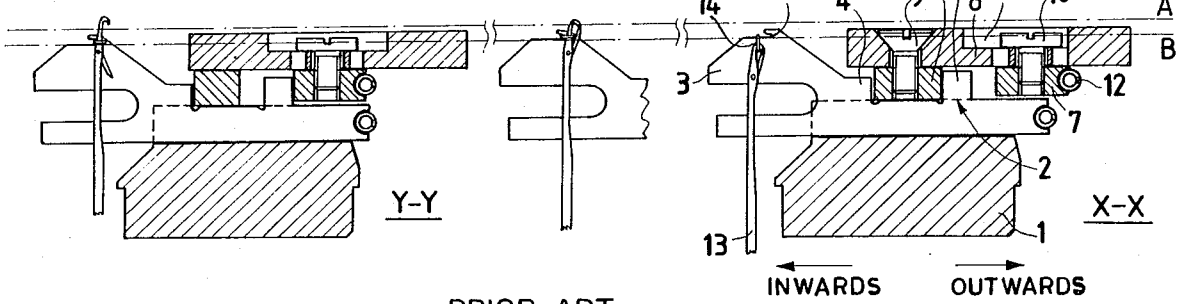
PRIOR ART Fig.1B
FIG. 1B shows the low position of the sinker in a prior art circular knitting machine.
Figure 1A:
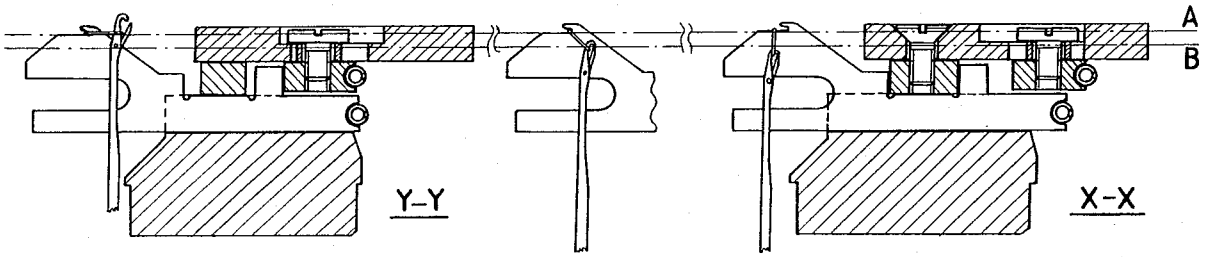
PRIOR ART Fig.1A
FIG. 1A shows the high position of the sinker in a prior art circular knitting machine.

In order to give the yarn loops a proper tension, the radial mobility of the sinkers is realized, in the most widely used machines, according to FIGS. 1A and 1B, by placing said sinkers on an annulus-shaped lower support 1, provided with radial slots 2, inside which the sinker 3 is guided during its reciprocating movement in the radial direction.

In the upper portion of the sinker 3, two vertical butts 4 and 5 are provided, which alternatively get engagement with the cams 6 and 7 supported by an upper, annulus-shaped support 8.

Figure 2:
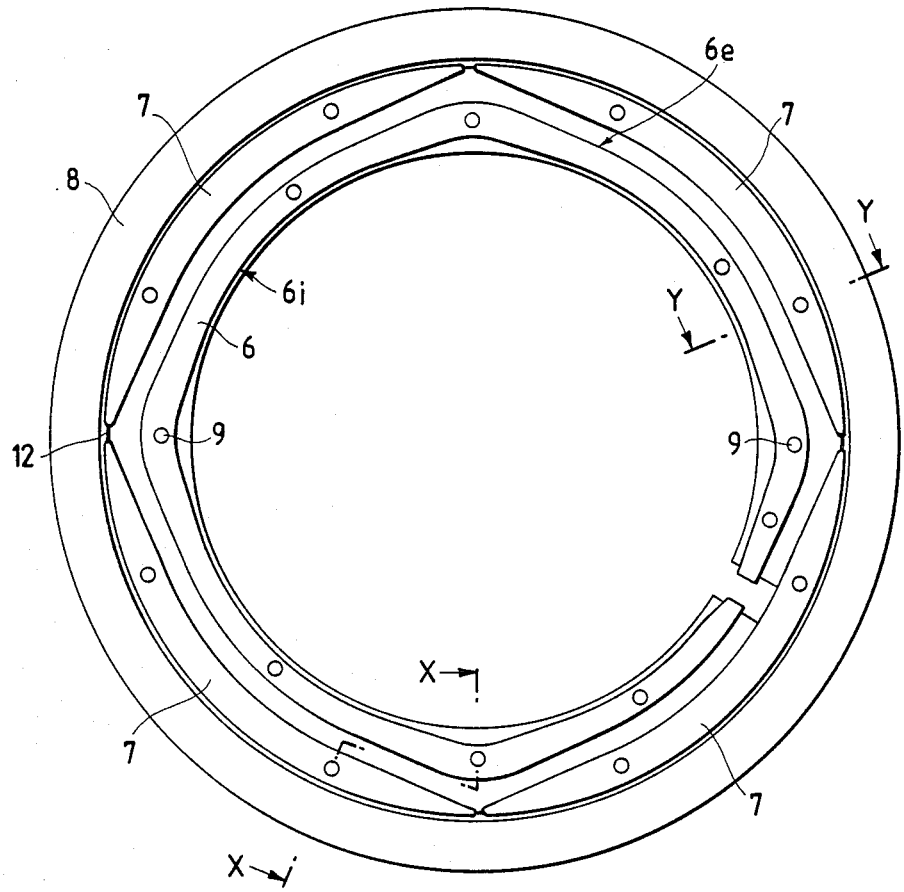
PRIOR ART Fig.2
FIG. 2 shows a prior art annular support carrying inner and outer cams.

The contour of cams 6 and 7 is shown in FIG. 2.

The inner cam 6 is substantially integral with 8, by being fastened to it by means of the stud bolts 9; the outer cam 7 is subdivided into a plurality of lengths—in exemplifying FIG. 2, four lengths—and is fastened to the support 8 by means of pins 10 inserted inside hollows 11, having a larger size, which allow the cam to radially move through a certain stroke. A circumferential spring 12 applies a containment force to the portions of the outer cam 7, weakly pushing it inwards. However, the inwards force radially applied by the spring should never exceed the tensile strength of the yarn, and when the needle 13 pulls the yarn 14 outwards, and applies an outwards-directed tensile force to the recess 15 of the sinker 3, the same spring should yield and allow the sinker to retract.

The recess 15, viz., the sinker, is pushed inwards by the spring 12 through an as long distance as allowed by the yarn 14; the yarn 14 is hence always under tension, and the loop is never slack.

FIG. 1A corresponds to long loops, with the sinkers high at level A.

FIG. 1B corresponds, on the contrary, to short loops, with sinkers low at level B.

One can observe that, with long loops, the "abundance" of yarn enables the sinkers 3 to move inwards by a longer stroke. The A and B levels are normally denominated as the "sinker knocking-over levels".

According to FIG. 2, both the contours of the innermost cam 6 are active: the inner contour 6i engages the butt 4, and pushes inward the sinker 3 when the corresponding needles are lowered under it, and the outer contour 6e engages the butt 5 and pushes outwards the sinker 3 when the corresponding needles start sinking after yarn catching.

Through the lengths along which the inner cam does not act, the radial position of the sinker 3 is then determined by the outermost cam 7.

The cam 7 operates—as regards the sinkers—by means of its inner contour only, which gets engaged with the butt 5 and pushes the sinkers 3 inwards, keeping the yarn loops always under tension.

This technical solution belongs to the prior art, and it does not show serious drawbacks when the machine runs at not very high speeds.

In the high-productivity machines, which operate at speeds higher than 1,000 revolutions per minute, the effects of the centrifugal forces applied to the sinkers, and applied by these latter to the cam 7, are such that such a technical solution cannot be any longer adopted without serious drawbacks.

In fact, it should be reminded that a circular knitting machine must be capable of considerably varying its revolution speed during the production of an article, e.g., when a change in needle selection is carried out.

If then, when high-speed operation is expected, a strong spring 12 is adopted, which is also capable of counteracting the effect of the centrifugal forces developed at high speeds, when the machine operates at slow speeds, the centrigual forces applied to the spring are small, and the force of the spring can hence exceed the tensile strength of the yarn 14, and, consequently, tear it.

Thus, in order to be able to control the radial position of the sinkers in high-speed circular knitting machines, it is necessary to resort to a control system which determines the radial approach and the radial pushing away of the outer cam 7 as a function of the length of the formed loops.

In the prior art, some technical solution to meet this requirement have been proposed.

In U.K. Patent Application 2,091,301, the approach and pushing away of the cams which control the radial position of the sinkers is controlled by levers which move on vertical planes passing through the axis of the cylinder, and are directly driven by the same lifting of the sinkers.

In German Patent Application 3,246,653, the contour lengths constituting the outer cam 7 are articulated and hinged to the support 8, and they are made radially approach and move away with a pivoting movement by means of telescopic components.

In U.S. Pat. No. 3,703,819, the length of the stitch loops is controlled by subdividing the sinkers into two half-sinkers, capable of relative radial movement, which makes it possible the overall configuration of the sinker to be changed.

The radial movement of the two half-sinkers is controlled by acting on the butts located at their ends, one upwards, and the other downwards, which are engaged inside two cam/countercam assemblies, analogous to those as hereinabove described, positioned on different planes perpendicular to the axis of the cylinder.

The cams and countercams are moved by radially moving sliders, inwards urged by radial springs, and driven by means of further periferally positioned approaching and pushing-away cams.

Such radial springs cause the position of the sinkers to be influenced by the revolution speed of the machine.

But all such technical solutions result very complex, and do not secure the accuracy and gradualness of the radial movement.

The control device according to the present invention makes it possible for the radial position of the outer cam 7 to be adjusted as a function of the level of the sinkers 3 with gradualness and accuracy.

It will be disclosed with reference to the practical embodiment of FIG. 3, wherein the elements 6, 7, 8, 9, 10, 11, correspond to the same elements as of FIG. 2.

According to the invention, the cam 7, and, more precisely, its component lengths, is given, along its outer contour, with a plurality of peripheral protrusions 16, preferably having a curved outline.

Externally around cam 7, a circular countercam 17 is concentrically provided, whose inner contour is shaped with gradual radial approach and pushing-away lengths 18, located opposite to the protrusions 16.

In the Figures, the protrusions 16 provided on the outer circular cam 7 and the recesses 18 provided on the circular countercam 17 are shown. It is evident that such an arrangement can be inverted, with the recesses 18 being provided on the cam 7, and the protrusions 16 being provided on the circular countercam 17, without changing the spirit and the scope of the invention, the two arrangements being perfectly equivalent.

It results evident that, when the machine is operating, and the cylinder is revolving, and with it also the sinker bearing group revolves, the cam 7—or, better, its component lengths—by the effect of centrifugal force applied by the sinkers adheres with its protrusions 16 to the countercam 17.

The adjustment of the radial position of the cam 7 is determined by making the countercam 17 rotate through a discrete angle around the centre C, which lays on the axis of the cylinder, according to arrow R. With such a rotation, opposite to the protrusions 16 a portion of the approaching length is positioned, which is more or less near to the centre C, and through such a contact the component lengths of the cam 7 are respectively moved inwards or retracted.

In FIGS. 3A and 3B the A position—long loop - which corresponds to a longer inwards advancement of the sinkers; as well as the B position—short loop—corresponding to a longer outwards retraction of the sinkers, are shown.

The rotation R from a position of minimum radial inwards advancement, to a position of maximum radial inwards advancement of the cam 7, and, consequently, of the sinkers, is enslaved by known means—e.g., by means of a kinematic transmission containing conical gearings—to the respectively minimum and maximum axial level of the sinker knocking-over plane, i.e., of point 15.

Figure 4:
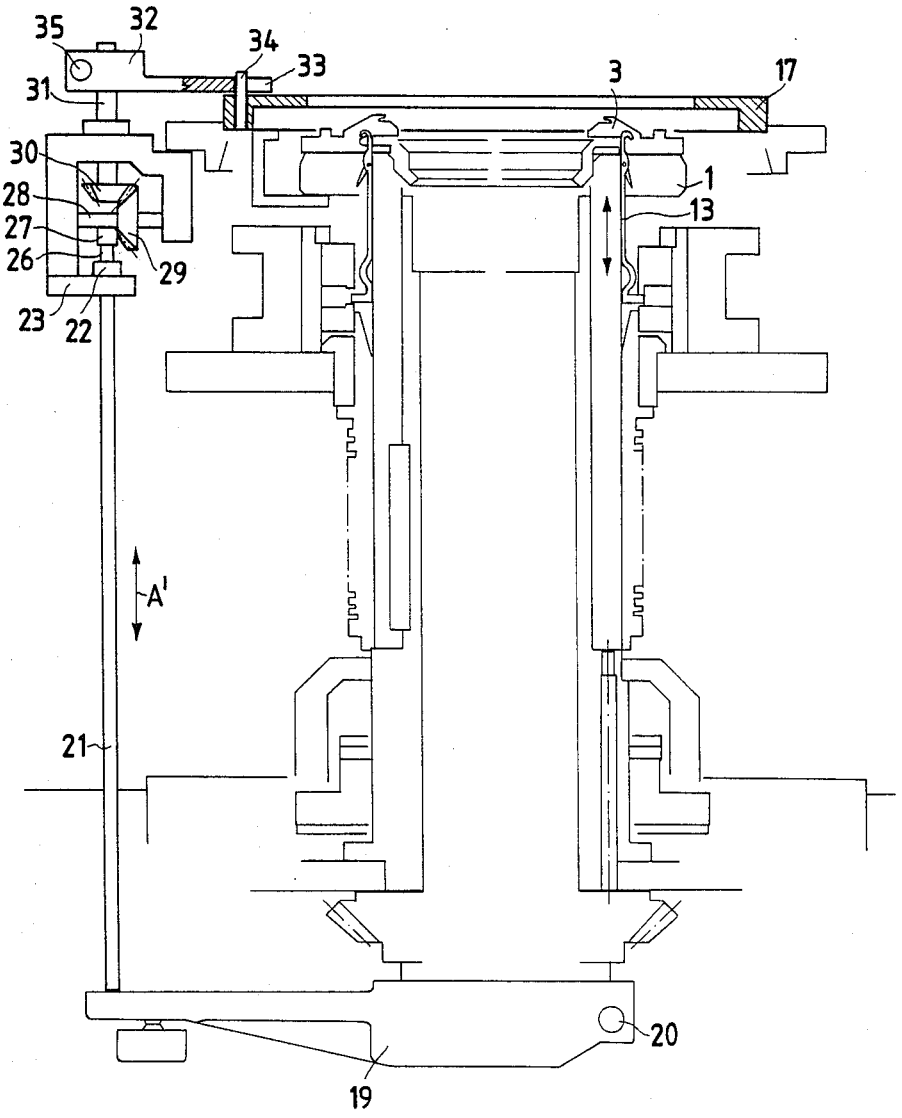
FIG. 4 shows a diagram of the circular knitting machine and the kinematic transmission controlling the rotation of the countercam of the present invention.

Such kinematic transmission is shown, for exemplifying purposes, in FIGS. 4 and 5A and 5B.

FIG. 4 is a diagram showing the circular machine and the kinematic transmission controlling the rotation of the circular countercam 17. FIG. 5A shows a top plan view of said countercam 17, and FIG. 5B shows a side view of the conical-gearing control kinematic transmission.

The lifting of the splined needle-holder cylinder of the machine, and, with it, of the circular support 1 which supports and guides the sinkers 3, is achieved by means of a plate 19 which is pivotally moved around the pivot 20, according to a kinematic arrangement known from the prior art.

The lifting of the circular support 1 causes the stitch loops formed in cooperation by the needles 13 and the sinkers 3 to be made longer. Simultaneously to the lifting and the sinking of the needle-holder cylinder caused by the pivoting movement of the plate 19, its movement in the axial direction is transmitted by the rod 21, which moves as shown by arrow A'.

The rod 21 is integral with the arm 22, which translates coherently, remaining parallel to itself, shifting relatively to the stationary frame 23, according to the movement allowed by the through pin 24 which moves together with 22 inside the through slot 25 provided in the support 23.

The A motion of the arm 22 is transmitted, by means of the adjustable push-rod 26, to the arm 27, which is constrained with the pivot 28 to move according to B' revolving motion; the conical gear wheel 29 rotates with the pin 28, and makes a second conical gear 30 rotate according to revolving motion C.

The pivot 31 is integral, with its lower end, with the conical gear wheel 30; and, with its upper end, with the arm 32 which, by means of its fork-shaped end 33, engages with the stud 34 integral with the countercam 17, causes the above mentioned rotation R. A through bore 35 provided at the other end of 32, and a clamp 36 make it possible the arm 32 to be blocked on the revolving pivot 31.

The contact of the arm 22 with the push-rod 26 is always secured by the spring 37.

The device according to the invention makes it possible all the component lengths of the cam 7 to be gradually and accurately positioned by means of the rotation of one single actuator element, and does not resort to a pluraly of complex components, whose action must be coordinated and controlled.

I claim:

1. A control device for adjusting the radial position of the sinkers in a circular knitting machine provided with means for varying the level of the plane of the sinkers and the length of the stitch loops, comprising two concentrical cams having a substantially circular contour laying on a plane perpendicular to the axis of the cylinder and with their center being positioned on the axis of the cylinder, an annular-shaped support keeping said concentrical cams in position, said innermost can being radially stationary and the outermost cam being subdivided into a plurality of lengths, means attaching said lengths of said outermost cams to said annular-shaped support to enable said lengths of said outermost cam to approach to, and move away from, the cylinder of the machine, in a discrete fashion, in the radial direction, said lengths which compose the outermost cam being provided with peripheral shaped portions along their outer contours; a substantially circular rotatable countercam concentrically located around said outermost cam, said counter cam being provided with an inner contour which is provided with shaped inner portions which contact the radially movable outer peripheral shaped portions of said lengths of said outermost cam, said lengths of said outermost cam movable radially inwardly by discrete rotation of said countercam.

2. The control device for adjusting the radial position of the sinkers according to claim 1, wherein the peripheral shaped portions of the outermost cam contain protrusions that have a curved contour.

3. The control device for adjusting the radial position of the sinkers according to claim 2, wherein the peripheral protrusions of the component lengths of the outermost cam are kept engaged with the countercam during the machine running by the effect of the centrifugal force acting on the sinkers.

4. The control device for adjusting the radial position of the sinkers according to claim 1, wherein the discrete rotation of the countercam is enslaved to the level of the knocking-over plane of the sinkers.

5. The control device according to claim 4, wherein the discrete rotation of the countercam from a position of minimum radial advancement, to a position of maximum radial advancement, of the sinkers, is enslaved to the axial positioning of the respectively lowermost level and uppermost level of the plane of the sinkers.

6. The control device according to claim 4, including a vertical pin integral with said countercam, a horizontal arm pivotable around said pin, conical gears to rotate said horizontal arm and a movable vertical rod to induce rotation of said conical gears, said vertical rod vertically movable with the axial positioning of the plane of the sinkers.

7. The control device according to claim 5, including a vertical pin integral with said countercam, a horizontal arm pivotable around said pin, conical gears to rotate said horizontal arm and a movable vertical rod to induce rotation of said conical gears, said vertical rod vertically movable with the axial positioning of the plane of the sinkers.

* * * * *